US011196160B2

(12) United States Patent
Choudhury et al.

(10) Patent No.: US 11,196,160 B2
(45) Date of Patent: Dec. 7, 2021

(54) DUAL-POLARIZED RETRODIRECTIVE ARRAY AND MULTI-FREQUENCY ANTENNA ELEMENT

(71) Applicant: Intel Corporation, Santa Clara, CA (US)

(72) Inventors: Debabani Choudhury, Thousand Oaks, CA (US); Shuhei Yamada, Hillsboro, OR (US)

(73) Assignee: INTEL CORPORATION, Santa Clara, CA (US)

( * ) Notice: Subject to any disclaimer, the term of this patent is extended or adjusted under 35 U.S.C. 154(b) by 0 days.

(21) Appl. No.: 16/650,101

(22) PCT Filed: Jan. 3, 2018

(86) PCT No.: PCT/US2018/012133

§ 371 (c)(1),
(2) Date: Mar. 24, 2020

(87) PCT Pub. No.: WO2019/135736

PCT Pub. Date: Jul. 11, 2019

(65) Prior Publication Data

US 2020/0335867 A1 Oct. 22, 2020

(51) Int. Cl.

| | |
|---|---|
| ***H01Q 3/26*** | (2006.01) |
| ***H01Q 5/40*** | (2015.01) |
| ***H01Q 9/04*** | (2006.01) |
| ***H01Q 21/06*** | (2006.01) |

(52) U.S. Cl.

CPC ..... *H01Q 3/2647* (2013.01); *H01Q 5/40* (2015.01); *H01Q 9/0414* (2013.01); *H01Q 21/065* (2013.01)

(58) Field of Classification Search

CPC .. H01Q 9/0414; H01Q 9/0457; H01Q 3/2647; H01Q 21/065

See application file for complete search history.

(56) References Cited

U.S. PATENT DOCUMENTS

| | | | | |
|---|---|---|---|---|
| 6,351,244 | B1 * | 2/2002 | Snygg | H01Q 1/246 343/770 |
| 10,468,780 | B1 * | 11/2019 | Milroy | H01Q 1/288 |
| 2013/0063310 | A1 | 3/2013 | Mak et al. | |
| 2014/0062788 | A1 * | 3/2014 | Coleman | H01Q 21/205 342/385 |

(Continued)

OTHER PUBLICATIONS

Ryan Y. Miyamoto, et al.; "Digital Wireless Sensor Server Using an Adaptive Smart-Antenna/Retrodirective Array" IEEE Transactions on Vehicular Technology, vol. 52, No. 5, Sep. 2003, p. 1181-1188.

(Continued)

*Primary Examiner* — Lam T Mai
(74) *Attorney, Agent, or Firm* — Viering, Jentschura & Partner mbB

(57) ABSTRACT

Systems, methods, and circuitries are disclosed for providing a retrodirective array. One example retrodirective array includes a plurality of dual-polarized antenna elements configured to receive a pilot signal having a first polarization and phase conjugation circuitry. The phase conjugation circuitry includes, for each of the plurality of antenna elements, a mixer configured to mix the pilot signal with an LO signal to generate a phase conjugated signal and excitation circuitry configured to generate an excitation signal for the antenna element to transmit the phase conjugated signal with a second polarization that is different from the first polarization.

23 Claims, 6 Drawing Sheets

(56) References Cited

U.S. PATENT DOCUMENTS

| | | | | |
|---|---|---|---|---|
| 2014/0134963 | A1* | 5/2014 | Aryanfar | H04B 1/44 455/78 |
| 2015/0340759 | A1* | 11/2015 | Bridgelall | B64D 43/00 370/329 |
| 2019/0067809 | A1* | 2/2019 | Coleman | H01Q 21/205 |
| 2019/0363438 | A1* | 11/2019 | Kirknes | G06K 19/0672 |

OTHER PUBLICATIONS

S. Macy, et al.; "Dual-Band Slot-Loaded Patch Antenna"; IEEE Proc.-Microw. Antennas Propag., vol. 142, No. 3, Jun. 1995, p. 225-232.

Ryan Y. Miyamoto, et al.; "Retroactive Arrays for Wireless Communication"; IEEE Microwave Magazine, Mar. 2002, p. 71-79.

Bee Yen Toh, et al.; "Assessment of Performance Limitations of POIV Retrodirective Arrays"; IEEE Transactions on Antennas and Propagation, vol. 50, No. 10, Oct. 2002, p. 1425-1432.

Hag Nawaz, et al.; "Communication: Dual-Polarized, Differential fed Microstrip Patch Antennas with Very High Interport Isolation for Full-Duplex Communication"; IEEE Transactions on Antennas and Propagation, vol. 65, No. 12, Dec. 2017, p. 7355-7360.

Bjorn Debaillie, et al.; "Analog/RF Solutions Enabling Compact Full-Duplex Radios"; IEEE Journal on Selected Areas in Communication, vol. 32, No. 9, Sep. 2014, p. 1662-1672.

International Search Report in connection with PCT Application PCT/US2018/012133 dated Nov. 26, 2018, p. 1-7.

Written Opinion in connection with PCT Application PCT/US2018/012133 dated Nov. 26, 2018, p. 1-15.

* cited by examiner

DUAL-POLARIZED RETRODIRECTIVE ARRAY AND MULTI-FREQUENCY ANTENNA ELEMENT

This application is a National Phase entry application of International Patent Application No. PCT/US2018/012133 filed Jan. 3, 2018, entitled "DUAL-POLARIZED RETRODIRECTIVE ARRAY AND MULTI-FREQUENCY ANTENNA ELEMENT" in the name of Debabani Choudbury, et al. and is hereby incorporated by reference in its entirety.

BACKGROUND

The phased array antenna play an important role in next-generation wireless communication and radar applications, because the array exhibits higher directivity, narrower beam width and improved beam scanning capabilities. In general, large/massive antenna arrays with large numbers of individual antenna elements are utilized to achieve better antenna directivity and scanning range, but as the array size increases, so does the size of the wireless platform. Further, large arrays have a higher manufacturing cost.

Beamforming is a signal processing technique used in sensor arrays for improving signal transmission and reception. In wireless communication systems, beamforming can be accomplished by arranging the elements in an antenna array so that signals at particular angles experience constructive interference at the receiver while others experience destructive interference. Multiple antenna elements transmit (or receive) signals derived from the same signal, but controlled in phase and/or amplitude so that the combined signals are "steered" (i.e., experience constructive interference, in general) toward the desired direction.

DETAILED DESCRIPTION

Figure 1:
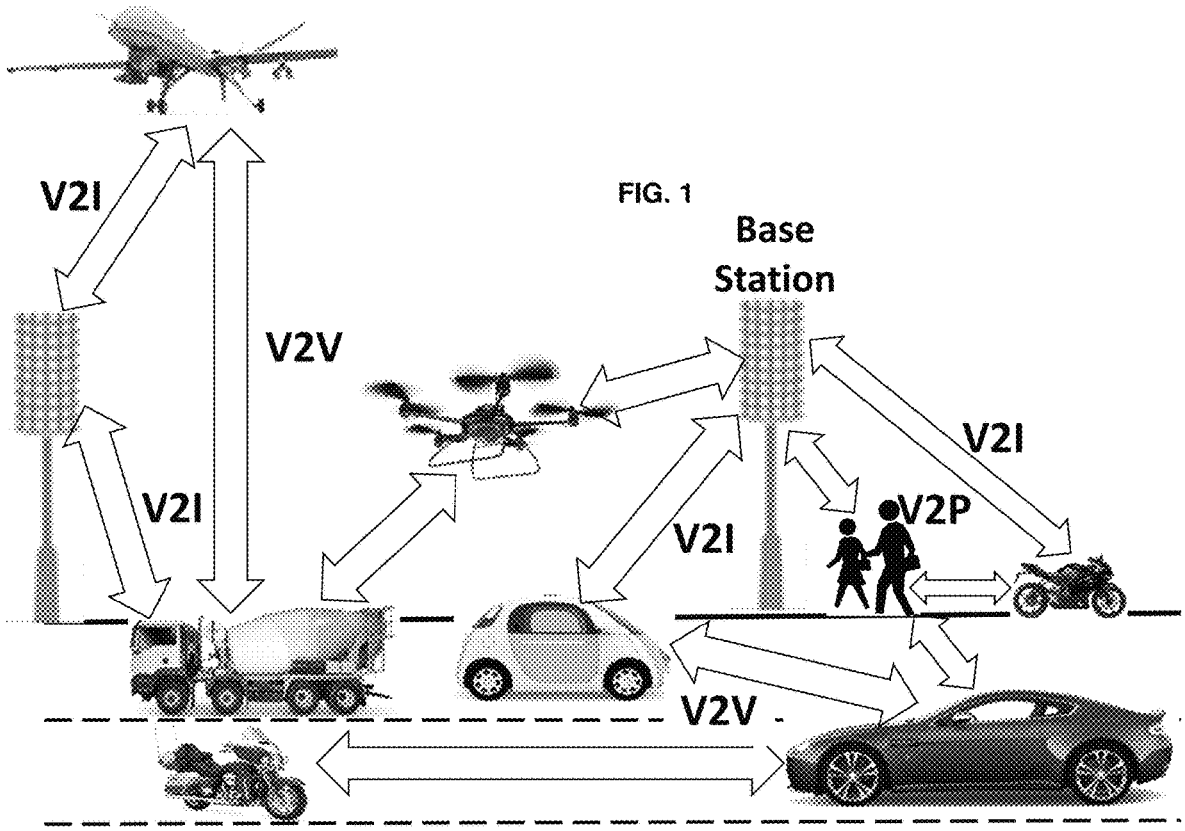
FIG. 1 illustrates an example vehicle-to-everything (V2X) connectivity scenario.

FIG. 1 illustrates an example connectivity scenario for Vehicle-To-Everything (V2X) showing the complex requirements and need for an efficient multi-dimensional vehicular as well as infrastructure communication network in the near future. Vehicle embedded radar and communication systems should have precise antenna beam control to enable beam searching and tracking processes for optimal beamforming performance. In general, a narrower antenna beam width reduces spatial ambiguity, results in better resolution and accurate sensing capability in radar sensing applications. Also in wireless communication technology, higher directivity helps to achieve an improved link budget and the narrow beam width helps to make the communication secure.

Figure 1A:
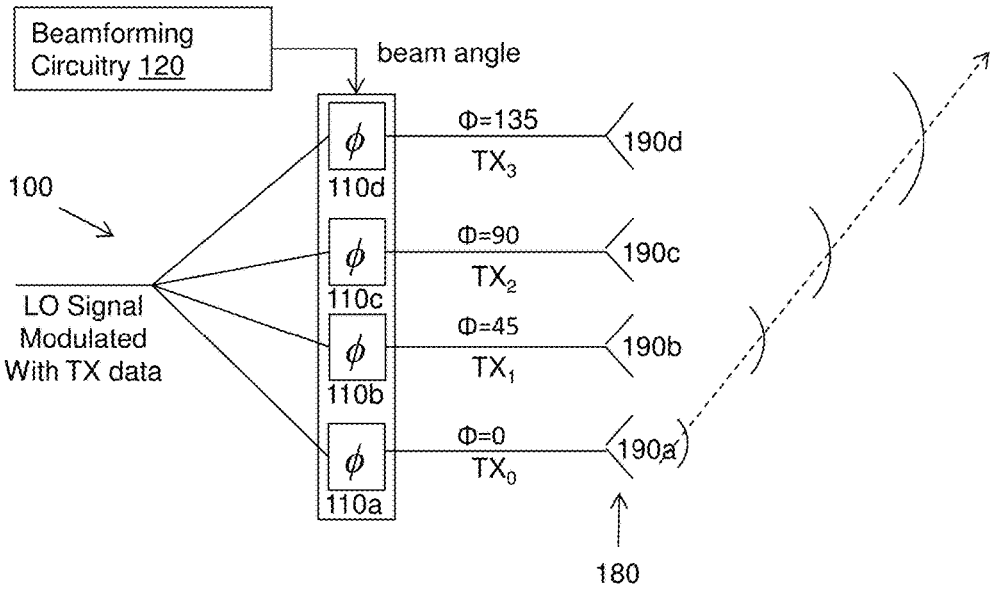
FIG. 1A illustrates an example phased array antenna system that may be used by one or more of the devices in the V2X connectivity scenario.

FIG. 1A is a schematic illustration of a simplified phased array antenna system 100 that may be used by any of the devices of FIG. 1 to receive and transmit beamformed signals. The phased array antenna system includes an array antenna 180 with multiple antenna elements 190*a*-190*d* and multiple phase shifters 110*a*-110*d*, with each antenna having a dedicated or corresponding phase shifter. The phased array antenna system 100 creates a "beam" of radio waves which can be electronically steered to point in different directions, without moving the antennas. The beam is created by feeding the signal (e.g., the "transmit signal" TX) from the transmitter to the individual antenna elements 190*a*-190*d* with adjusted phase relationships so that the transmit signal waves from the separate antenna elements 190*a*-190*d* add together to increase the radiation in a desired direction, while cancelling to suppress radiation in undesired directions. The TX signal from the transmitter is fed to the antenna elements 190*a*-190*d* through the phase shifters 110*a*-110*d*, which are controlled by a computer system to alter the phase electronically, thus steering the beam of radio waves to a desired direction.

It can be seen in FIG. 1A that the transmit signal TX1 from the second antenna element is shifted in phase by 45° as compared to the transmit signal TX0 from the first antenna element. Likewise, the transmit signal TX2 from the third antenna element is shifted in phase by 90° as compared to the transmit signal TX0 from the first antenna element and the transmit signal TX3 from the fourth antenna element is shifted in phase by 135° as compared to the transmit signal TX0 from the first antenna element. The combined signals result in a beam that is focused in the general direction (called herein the "beam angle") shown by the arrow.

In order to determine the desired beam angle, which is converted into the phase shifts of FIG. 1A, beamforming circuitry 120 uses a direction of arrival (DOA) algorithm to perform a beam search and tracking process. It becomes more challenging to implement the beam search and tracking processes with the intensely narrowed antenna beam widths of modern wireless systems. Current wireless systems use a sector level sweep (SLS) with beam broadening/refinement technique to establish and maintain beams. However this process often involves complex signal processing and requires scanning time to identify optimal scan angle. Also the system needs to have fine resolution phase shifter to support such precise beam controlling.

Figure 2:
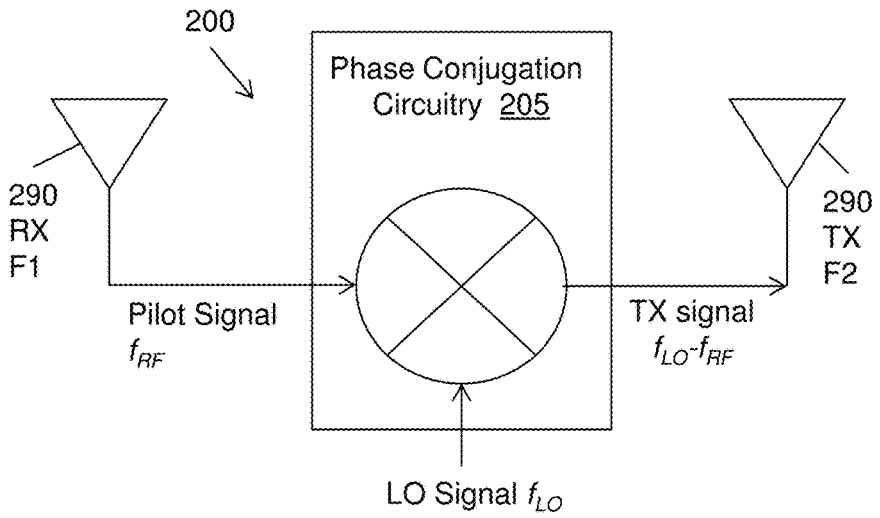
FIG. 2 illustrates a functional diagram of an example phase conjugation circuitry for use in a retro-directive array to steer a transmitted signal in a direction from which a signal was received.

In order to avoid the problems caused by performing beam searching and tracking, a retro-directive array (RDA) system can be used which automatically steers the beam towards the direction of incoming received signal (hereinafter "angle of arrival"). FIG. 2 illustrates a functional diagram of an RDA system 200 that includes an array antenna (a single antenna element 290 is shown as a separate RX component and TX component for simplicity sake). The RDA system 200 also includes a phase conjugation circuitry 205. A pilot signal transmitted from a target is received by the RDA system 200. The received pilot signal has a frequency ($f_{RF}$) in each path that contains phase information depending on the angle of arrival of the pilot signal. The received pilot signal is mixed with an LO signal by the mixer. The LO signal has a frequency $f_{LO}$ and has been modulated to encode data being transmitted. The down-converted LO signal ($f_{LO}-f_{RF}$) generated by the mixer will have a conjugated phase as compared to the received pilot signal. For example, if the phase of the received pilot signal is +30°, the output signal of the phase conjugation circuitry is −30°. By implementing this technique, the RDA system 200 is able to steer the beam without needing a phase shifter 110 or beamforming circuitry 120 used by the conventional phased array system 100 of FIG. 1 to determine a beam angle.

Figure 2A:
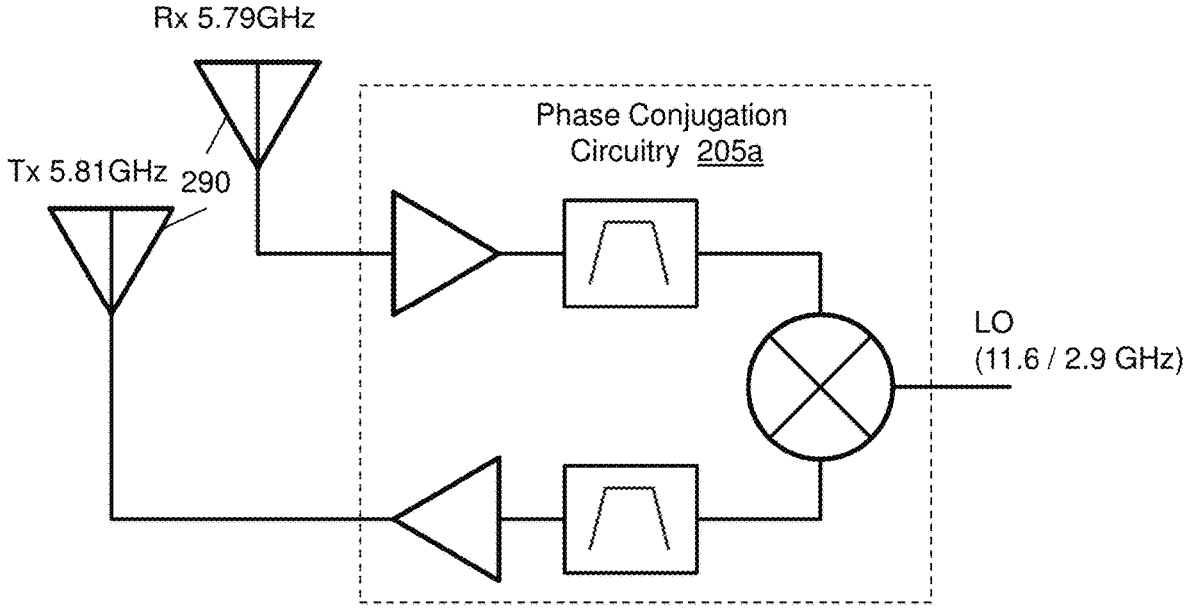
FIG. 2A illustrates an example phase conjugation circuitry for use in a retro-directive array to steer a transmitted signal in a direction from which a signal was received.

FIG. 2A illustrates a block diagram of one example conventional retrodirective array (RDA) system 200*a* that includes a phase conjugation circuitry 205*a*. The received signal has a frequency of 5.79 GHz and is first amplified by a low-noise amplifier (LNA), filtered, and then applied to a mixer. The mixer is fed by an 11.6 GHz LO signal (which is twice the frequency of the received signal plus a small frequency offset to isolate between the received signal and the transmit signal). The output of the mixer is the signal having a conjugated phase as compared to the signal received by the Rx antenna. The phase conjugated signal is filtered and amplified and passed to the Tx antenna.

Due to the finite isolation between the received pilot signal and transmit signal, the system 200*a* requires frequency offset between the Rx and Tx signals. This frequency offset causes scanning angle error since the phase information between each antenna is achieved from the pilot signal frequency and applied to transmit signal at a different frequency. In addition, this frequency offset results in degradation of system performance by reducing the available bandwidth.

Disclosed herein are systems, circuitries, and methods that provide a retro-directive array (RDA) system that can be used at the same frequency for both the Rx and Tx signals by using polarization duplexing techniques to enhance the isolation between the Rx and Tx signals in the system. By applying a dual-polarization antenna and a polarization duplexing technique, the pilot signal can be transmitted with one polarity and the RDA signal can be transmitted on another polarization. With enhanced port-to-port isolation, the systems, circuitries, and methods can realize both pilot and transmitting signals having the same frequency. By using such dual polarization transmission techniques, it is possible to eliminate the phase and scan angle error caused by the frequency offset between the RDA and pilot signals in the conventional retro-directive array system, such as the system shown in FIG. 2A.

Figure 3:
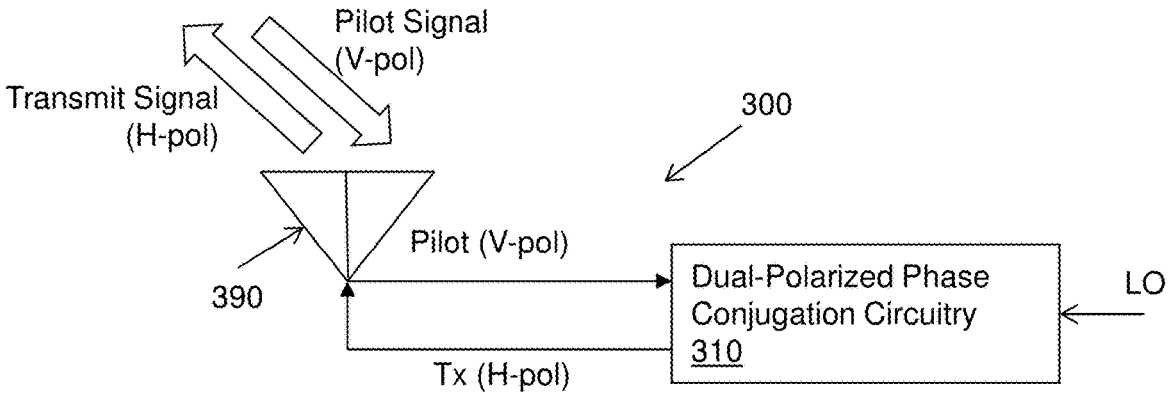
FIG. 3 illustrates a functional diagram of a dual-polarized retro-directive array that includes phase conjugation circuitry in accordance with various aspects described.

FIG. 3 illustrates a block diagram of an exemplary retrodirective array (RDA) system 300. A dual-polarized antenna element 390 is used to achieve both high polarization isolation as well as high port-to-port isolation. In the RDA system 300, to isolate the pilot signal from the Tx signal, the pilot signal is transmitted with one polarity (e.g., a vertical polarity, however, any polarity may be used) and the transmitting signal is on another polarity (e.g., horizontal polarity, however any polarity that is different from the polarity of the pilot signal may be used). In addition, enhanced port-to-port isolation exhibited by the antenna element 390 helps to isolate the two signals inside the system 300. By adequately isolating the Tx signal from the Rx signal, the pilot and Tx signals can operate at the same frequency to avoid scanning angle error and bandwidth reduction caused by the frequency offset between pilot and Tx signals in some conventional RDA systems, such as the system shown in FIG. 2A.

Figure 4A:
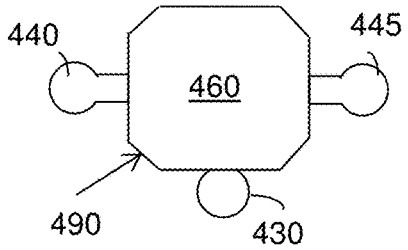
FIG. 4A illustrates a top view of an example high isolation dual-polarized antenna element in accordance with various aspects described.
Figure 4B:
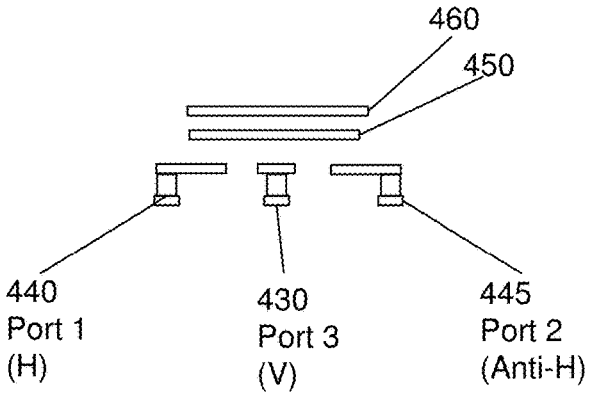
FIG. 4B illustrates a side view of the high isolation dual-polarized antenna element of FIG. 4A.

FIGS. 4A and 4B illustrate a top view and a side view, respectively, of an exemplary dual polarized high isolation antenna element 490. The antenna element 490 includes three ports 430, 440, and 445 which are vertical (V), horizontal (H), and anti-horizontal (Anti-H) ports, respectively. In other examples, other polarizations may be implemented by varying the excitation signals. In the horizontal polarization (which is applied to the Tx signal) a differential excitation scheme is implemented. In other examples, the differential excitation scheme may be implemented in other types of linear and circular polarizations such as vertical, left-hand circular, right-hand circular, and so on. The pilot signal is received by the port 430 disposed at one side of patch radiating elements 450, 460 (see FIG. 4B). Opposite phased Tx excitation signals (H and anti-H polarity) are applied at opposite edges of the square radiating elements 450, 460 to achieve high cross-pol suppression.

Figure 5:
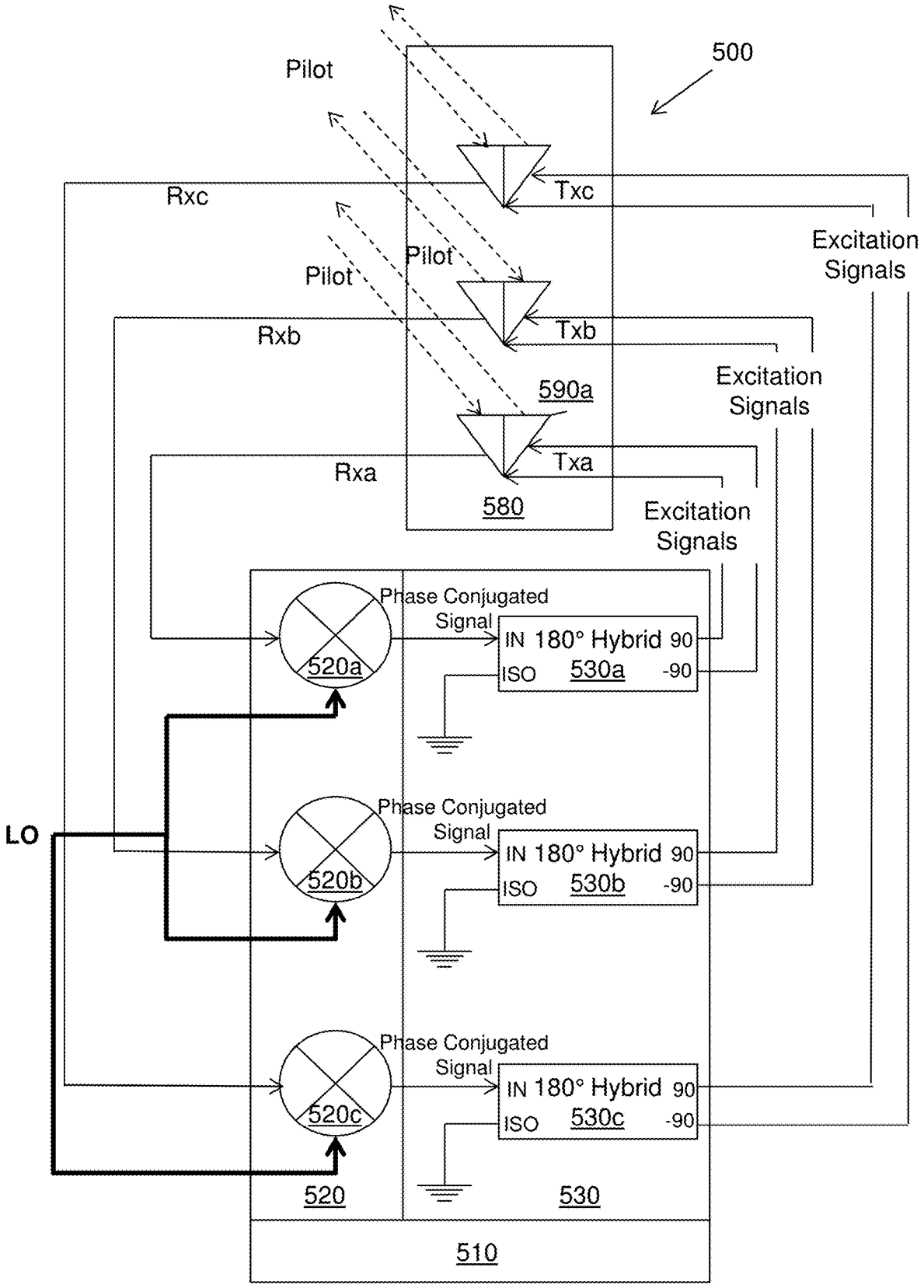
FIG. 5 illustrates a functional diagram of an example dual-polarized retro-directive array with three antenna elements that includes phase conjugation circuitry in accordance with various aspects described.

Since unwanted coupling signal to another polarization port results in increasing the cross-pol level, providing a differential excitation scheme in either of polarizations results in canceling of the unwanted coupling signal in both polarizations and enhancing of the port-to-port isolation. As can be seen in FIG. 5, the differential excitation scheme may be achieved by using a 180° hybrid coupler to split the Tx signal into the two opposite phased excitation signals. As already noted, other diverse polarizations (e.g., right-hand circular and left-hand circular) can be used instead of vertical and horizontal in some examples.

Figure 4C:
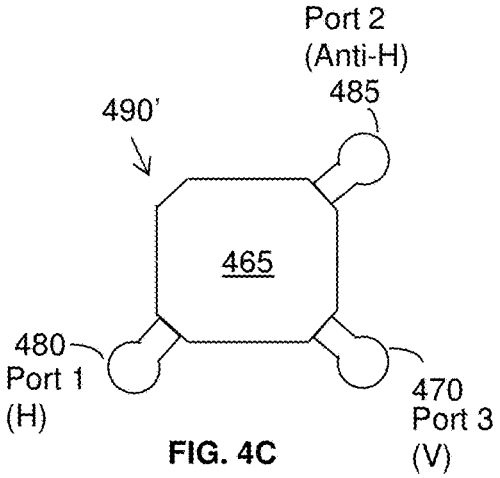
FIG. 4C illustrates a top view of an alternative example high isolation dual-polarized antenna element in accordance with various aspects described.

Other antenna elements that are capable of dual polarization may also be used. For example, FIG. 4C illustrates an alternative antenna element 490' that includes a vertical port 470 disposed at one corner of patch radiating elements (only element 465 is visible in FIG. 4C) and a horizontal port 480 and an anti-horizontal port 485 disposed at opposite corners of the patch radiating elements to apply differential excitation signals to the radiating elements.

Many other antenna element architectures may be used. For example, any number of radiating elements (more than the two illustrated in FIGS. 4A-4C) may be used. Also, antenna elements that do not use differential excitation signals to achieve dual polarization can be used. Further, radiating elements of any shape other than the illustrated square or rectangular patch shape, such as circular, elliptical, or irregular shapes, may be used in some examples.

FIG. 5 illustrates an example RDA system 500 that includes an array antenna 580 with three dual polarized antenna elements and corresponding phase conjugation circuitries 510. In other examples, the array 580 may include fewer or more antenna elements than the three illustrated in FIG. 5. A pilot signal having a first frequency (e.g., 60 Hz) is received by each of the three antenna elements. If the antenna elements are those described in FIGS. 4A and 4B, the pilot signal is output from the V-pol port 430 of the antenna element.

The phase conjugation circuitry 510 includes, for each antenna element, a mixer 520 and excitation circuitry 530. For the purposes of this description, only a single Tx/Rx chain is described (with reference characters ending in a) and it is to be understood that an analogous operation may be assumed for to the other two Tx/Rx chains. In the first Tx/Rx chain, the pilot signal received by the first antenna element 590*a* is input to a mixer 520*a* that mixes an LO signal having a second frequency with the pilot signal to generate a phase conjugated signal. The LO signal encodes (i.e., has been modulated by) transmit data to be communicated by the Tx signal. If the pilot signal has a frequency of 60 GHz and the LO signal has a frequency of 120 GHz, or 30 GHz with a sub-harmonic mixer, the phase conjugated signal generated by the mixer 520*a* has the same frequency as the pilot signal with a conjugated phase.

The phase conjugated signal is input to an excitation circuitry 530*a* that converts the phase conjugated signal into a pair of differential excitation signals which are input to the H-pol port 440 (FIG. 4) and anti-H pol port 445 of the first RDA antenna element. In the illustrated example, the excitation circuitry 530 includes 180° hybrid coupler circuitry for each antenna element. In another example, the excitation circuitry includes a power splitter with 180° phase offset. The differential excitation signals output by the excitation circuitry 530*a* cause the first antenna element 590*a* to transmit the Tx signal in the angle of arrival of the received pilot signal. Note that the phase conjugation circuitry may also include matching circuits, bandpass filters, amplifiers, and Tx-Rx isolation circuitries which are not shown in FIG. 5 for simplicity sake. In another example, the Rx port may be configured to receive differential pilot signals so that the input of the phase conjugation circuitry may include a 180° hybrid coupler or power combiner with 180° phase offset.

Figure 6:
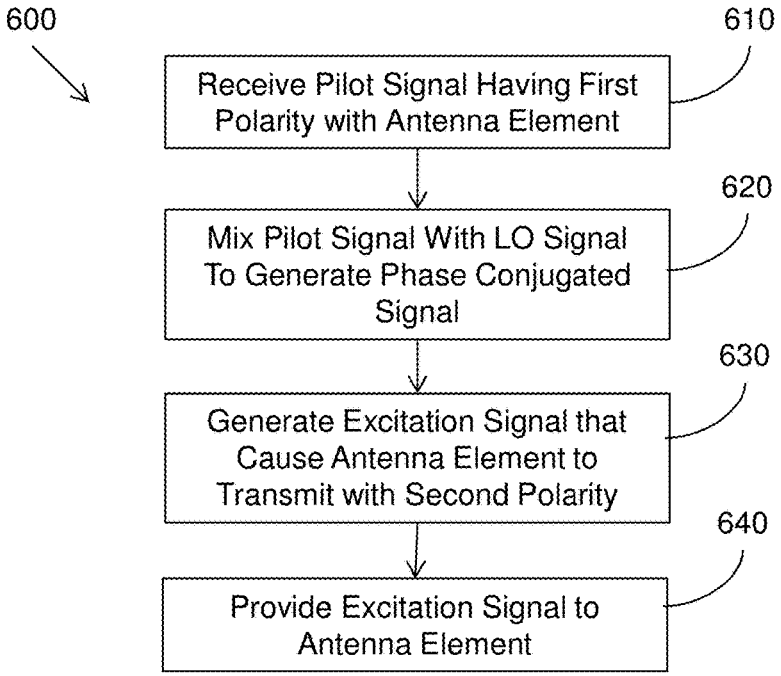
FIG. 6 illustrates an example method for transmitting a signal in a direction of an angle of arrival in accordance with various aspects described.

FIG. 6 illustrates an example method 600 configured to transmit a signal in a direction in which a pilot signal was received. The method includes, at 610, receiving a pilot signal having a first polarization with an antenna element. At 620, the pilot signal is mixed with an LO signal to generate a phase conjugated signal. An excitation signal is generated at 630. The excitation signal, when applied to the antenna element, will cause the antenna element to transmit the phase conjugated signal with a second polarization that is different from the first polarization. At 640, the excitation signal is applied to the antenna element.

Current wireless communication utilizes multiple carrier signal frequencies in order to provide faster data rates and more capacity. Radar systems also use different frequency signals depending on the detection objectives. In such cases, the system should support multiple frequencies or provide multiple redundant systems that operate at different frequencies. The use of multiple systems that operate at different frequencies makes the wireless system even larger and more expensive.

A dual polarized antenna architecture supports two orthogonally isolated polarizations (as described above in FIG. 4, for example). The dual-polarized antenna element can realize polarization diversity, which is one of the antenna diversity techniques that helps to improve the signal quality and reliability as well as assist in mitigating multipath interference and fading.

One existing dual-band antenna includes a shared port. This antenna requires simultaneous excitation in both frequencies, resulting in reduced energy efficiency when only a single frequency is needed. Further, this antenna is capable of only a single polarization.

Disclosed herein are systems and circuitries that provide a multi-port, multi-frequency band, dual-polarized antenna element that can operate at different frequency bands simultaneously or in either frequency alone. The antenna element includes separate excitation ports for the different frequencies and polarizations. In addition, the impedance of the ports is controlled to avoid unwanted port-to-port coupling and gain reduction.

Figure 7A:
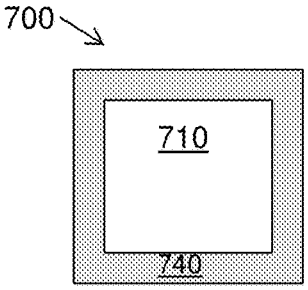
FIG. 7A illustrates a top view of an example multi-frequency dual polarized antenna element in accordance with various aspects described.

FIG. 7A illustrates an example multi-port, multi-frequency band, dual-polarized (MPMFDP) antenna element 700 that can operate at different frequency bands simultaneously or in either frequency alone. The MPMFDP antenna element 700 includes a higher frequency band patch type dual-polarized radiating element 710 stacked or disposed on a lower frequency band dual-polarized radiating element 740 using a multi-layer substrate stackup. Close placement of both radiating elements in this topology introduces interference and unwanted port to port signal coupling, which reduces antenna gain.

Figure 7B:
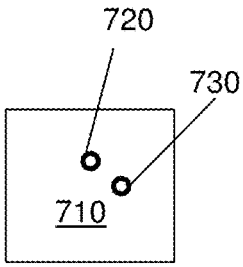
FIGS. 7B and 7C illustrate bottom views of the two radiating elements in the multi-frequency dual polarized antenna element of FIG. 7A.
Figure 7C:
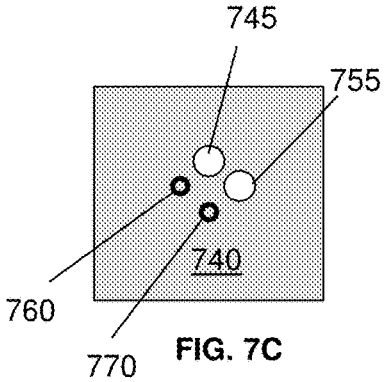
Figure 7D:
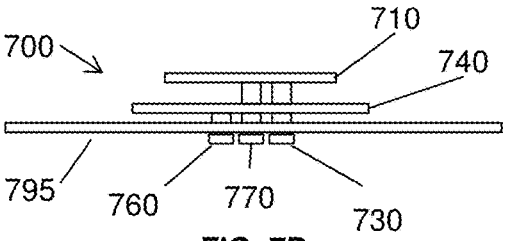
FIG. 7D illustrates a side view of the multi-frequency dual polarized antenna element of FIG. 7A.

FIGS. 7B and 7C illustrate bottom views of the radiating elements 710, 740, respectively. Each radiating element may be implemented on different layers of a multi-layer printed circuit board (PCB). The higher frequency radiating element 710 is smaller in size than the lower frequency radiating element 740. The higher frequency radiating element 710 includes a vertical polarization port 720 and a horizontal polarization port 730. A via (seen in FIG. 7D) extends from each port and provides a path for the signal to travel through PCB layers from the port to the radiating element. The vias can travel through a ground plane 795 as well as through other antenna elements.

In one example, the higher frequency radiating element 710 is configured to transmit and receive signals at 39 GHz while the lower frequency radiating element 740 is configured to transmit and receive signals at 28 GHz. The radiating element 740 includes a vertical polarization port 770 and a horizontal polarization port 760. It can be seen that the horizontal and vertical ports of each radiating element are disposed orthogonal to one another. Clearance holes 745, 755 in the lower frequency radiating element 740 provide clearance for the vias of the ports 720, 730 of the higher frequency radiating element 710. The clearance holes are sized so that some gap (anti-pad) is maintained around the signal vias for the high frequency signal to ensure isolation. Since a patch antenna has less E-field around the center of the antenna element, the effect of the vias and gaps on antenna performance is minimal.

To enhance port to port isolation between the two radiating elements, the port impedance of each element is controlled during the design process so that the impedance is matched at the operating frequency of the radiating element and mismatched at the operating frequency of the other radiating element. For example if the port impedance of the high frequency ports 720, 730 is 2000, then there is about 10.25 dB of isolation between the high frequency ports and the low frequency ports 750, 760. Alternatively, or in addition, a filter may be used to filter signals of the other radiating element's frequency from the signal being input to or output by the port.

While only two radiating elements are illustrated in FIGS. 7A-7D, any number of radiating elements, each tuned for different operating frequencies, may be stacked in addition to the illustrated elements. Further, while, square/rectangular patch elements are illustrated, the elements may be circular, elliptical, or irregularly shaped patches of conductive material in some examples.

Since the ports for the different bands are separate, it is possible to excite only one band or a combination of bands simultaneously. In this manner, the MPMFDP antenna element 700 realizes a smaller form factor, lower manufacturing cost, and better signal quality by supporting multiple ports, multiple frequency bands, and dual polarization.

Figure 8:
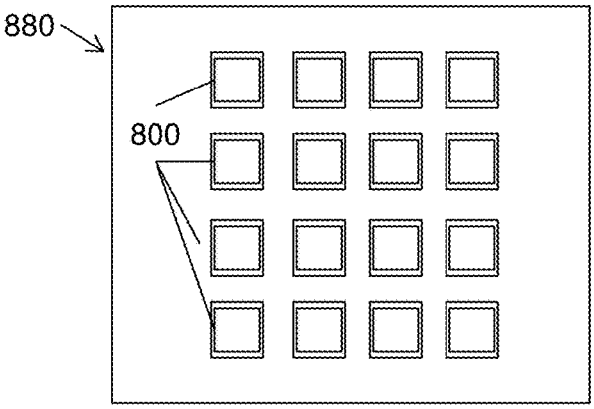
FIG. 8 illustrates a top view of an example array antenna that includes multi-frequency dual polarized antenna elements in accordance with various aspects described.

FIG. 8 illustrates at top view of an example array antenna 880 that includes a 4×4 matrix of MPMFDP antenna elements 800 arranged in an array pattern. While the array antenna 880 is illustrated as a square matrix array of elements, other array patterns of elements within the array may be used, including periodic, aperiodic, sparse, rectangular/triangular/circular lattice, and so on.

It can be seen from the foregoing description that the described systems, methods, and circuitries provide an RDA that isolates the pilot signal and Tx signal with two different polarizations so that the two signals may have the same frequency. This lack of frequency offset results in accurate beam steering. The use of a differential excitation signal scheme enhances the polarization isolation and the port-to-port isolation which result in improved performance of the RDA system. The combination of different frequency bands and different polarizations in one antenna element results in smaller form-factor and reduced manufacturing cost.

Figure 9:
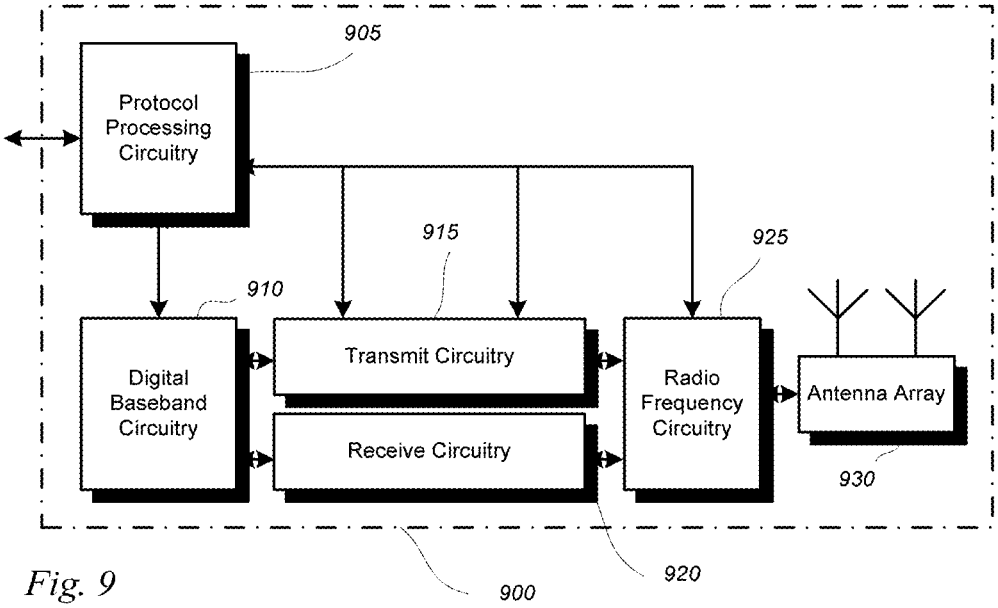
FIG. 9 illustrates an exemplary communication circuitry according to some aspects.

FIG. 9 illustrates an exemplary communication circuitry 900 according to some aspects. Circuitry 900 is alternatively grouped according to functions. Components as shown in 900 are shown here for illustrative purposes and may include other components not shown here in FIG. 9.

Communication circuitry 900 may include protocol processing circuitry 905, which may implement one or more of medium access control (MAC), radio link control (RLC), packet data convergence protocol (PDCP), radio resource control (RRC) and non-access stratum (NAS) functions. Protocol processing circuitry 905 may include one or more processing cores (not shown) to execute instructions and one or more memory structures (not shown) to store program and data information.

Communication circuitry 900 may further include digital baseband circuitry 910, which may implement physical layer (PHY) functions including one or more of hybrid automatic repeat request (HARQ) functions, scrambling and/or descrambling, coding and/or decoding, layer mapping and/or de-mapping, modulation symbol mapping, received symbol and/or bit metric determination, multi-antenna port pre-coding and/or decoding which may include one or more of space-time, space-frequency or spatial coding, reference signal generation and/or detection, preamble sequence generation and/or decoding, synchronization sequence generation and/or detection, control channel signal blind decoding, and other related functions.

Communication circuitry 900 may further include transmit circuitry 915, receive circuitry 920 and/or antenna array circuitry 930 which may include an array antenna 880 of FIG. 8 and/or antenna elements 490 of FIG. 4A, 490' of FIG. 4C, and/or 700 of FIGS. 7A-7D.

Communication circuitry 900 may further include radio frequency (RF) circuitry 925. In an aspect of the invention, RF circuitry 925 may include multiple parallel RF chains for one or more of transmit or receive functions, each connected to one or more antennas of the antenna array 930. The RF circuitry 925 may include excitation circuitry 510 of FIG. 5.

In an aspect of the disclosure, protocol processing circuitry 905 may include one or more instances of control circuitry (not shown) to provide control functions for one or more of digital baseband circuitry 910, transmit circuitry 915, receive circuitry 920, and/or radio frequency circuitry 925.

Use of the word exemplary is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form. Furthermore, to the extent that the terms "including", "includes", "having", "has", "with", or variants thereof are used in either the detailed description and the claims, such terms are intended to be inclusive in a manner similar to the term "comprising".

Examples herein can include subject matter such as a method, means for performing acts or blocks of the method, at least one machine-readable medium including executable instructions that, when performed by a machine (e.g., a processor with memory or the like) cause the machine to perform acts of the method or of an apparatus or system for concurrent communication using multiple communication technologies according to embodiments and examples described.

Example 1 is a system for a retrodirective array, including a plurality of dual-polarized antenna elements configured to receive a pilot signal having a first polarization and phase conjugation circuitry. The phase conjugation circuitry includes, for each antenna element, a mixer configured to mix the pilot signal with an LO signal to generate a phase conjugated signal and excitation circuitry configured to generate an excitation signal for the antenna element to transmit the phase conjugated signal with a second polarization that is different from the first polarization.

Example 2 includes the subject matter of example 1, including or omitting optional elements, wherein the pilot signal and the phase conjugated signal have the same frequency.

Example 3 includes the subject matter of example 1, including or omitting optional elements, wherein the excitation circuitry includes a 180° hybrid coupler circuitry.

Example 4 includes the subject matter of example 1, including or omitting optional elements, wherein the excitation circuitry includes a power splitter with 180° phase offset.

Example 5 includes the subject matter of examples 1-4, including or omitting optional elements, wherein the excitation circuitry is configured to generate a pair of differential excitation signals.

Example 6 includes the subject matter of example 5, including or omitting optional elements, wherein each dual-polarized antenna element of the plurality of dual-polarized antenna elements includes a first port and a second port configured to transmit signals with the second polarization and a third port configured to receive signals having the first polarization.

Example 7 includes the subject matter of example 5, including or omitting optional elements, wherein each dual-polarized antenna element of the plurality of dual-polarized antenna elements includes a first port and a second port configured to, with differential excitation signals, have the second polarization and a third port having the first polarization.

Example 8 includes the subject matter of example 5, including or omitting optional elements, wherein each dual-polarized antenna element of the plurality of dual-polarized antenna elements includes at least one radiating element and further wherein a first port and a second port are coupled to opposite edges of a radiating element.

Example 9 includes the subject matter of example 5, including or omitting optional elements, wherein each dual-polarized antenna element of the plurality of dual-polarized antenna elements includes at least one radiating element and further wherein a first port and a second port are coupled to opposite corners of a radiating element.

Example 10 includes the subject matter of examples 1-4, including or omitting optional elements, wherein the pilot signal comprises differential signals.

Example 11 is a method, including: receiving a pilot signal having a first polarity with an antenna element, wherein the pilot signal is received at an angle of arrival with reference to the antenna element; mixing the pilot signal with a local oscillator signal to generate a phase conjugated signal; generating an excitation signal, for the antenna element to transmit the phase conjugated signal with a second polarity that is different from the first polarity; and providing the excitation signal to the antenna element.

Example 12 includes the subject matter of example 11, including or omitting optional elements, wherein the pilot signal and the phase conjugated signal have the same frequency.

Example 13 includes the subject matter of example 11, including or omitting optional elements, further including generating a pair of differential excitation signals.

Example 14 includes the subject matter of example 13, including or omitting optional elements, further including providing the pair of differential signals to a pair of ports on the antenna element, wherein the pair of ports are disposed at opposite edges of a radiating element.

Example 15 is an antenna element, including a first radiating element configured to transmit at a first frequency; a first port coupled to the first radiating element, wherein the first port is configured to apply a first excitation signal to the first radiating element to transmit a first transmit signal at a first polarization; a second port coupled to the first radiating element, wherein the second port is configured to apply a second excitation signal to the first radiating element to transmit a second transmit signal at a second polarization different from the first polarization; a second radiating element configured to transmit at a second frequency that is different from the first frequency; a third port coupled to the second radiating element, wherein the third port is configured to apply a third excitation signal to the second radiating element to transmit a third transmit signal at the first polarization; and a fourth port coupled to the second radiating element, wherein the fourth port is configured to apply a fourth excitation signal to the second radiating element to transmit a fourth transmit signal at the second polarization.

Example 16 includes the subject matter of example 15, including or omitting optional elements, wherein the first frequency is higher than the second frequency.

Example 17 includes the subject matter of example 15, including or omitting optional elements, wherein the first radiating element is disposed on top of the second radiating element.

Example 18 includes the subject matter of example 17, including or omitting optional elements, wherein the second radiating element includes a first clearance hole for a via connected to the first port to pass through and a second clearance hole for a via connected to the second port to pass through.

Example 19 includes the subject matter of examples 15-18, including or omitting optional elements, wherein an impedance of the first port and the second port are selected to be matched at the first frequency and mismatched at the second frequency and wherein an impedance of the third port and the fourth port are selected to be matched at the second frequency and mismatched at the first frequency.

Example 20 includes the subject matter of examples 15-18 including or omitting optional elements, further including: a third radiating element configured to transmit at a third frequency that is different from the first frequency and the second frequency; a fifth port coupled to the third radiating element, wherein the fifth port is configured to apply a fifth excitation signal to the third radiating element to transmit a fifth transmit signal at the first polarization; and a sixth port coupled to the third radiating element, wherein the sixth port is configured to apply a sixth excitation signal to the third radiating element to transmit a sixth transmit signal at the second polarization.

Example 21 includes the subject matter of examples 15-18 including or omitting optional elements, wherein each of the radiating elements includes a rectangular patch of conductive material.

Example 22 includes the subject matter of example 21, including or omitting optional elements, wherein each of the radiating elements includes a circular, elliptical, or irregularly-shaped patch of conductive material.

Example 23 is a phased array antenna, including a plurality of multi-frequency antenna elements disposed in a pattern, wherein each multi-frequency antenna element is configured to transmit signals at a first frequency or a second frequency, or a combination of the first and second frequencies simultaneously.

Example 24 includes the subject matter of example 23, including or omitting optional elements, wherein the multi-frequency antenna elements are disposed in a matrix array pattern.

Example 25 includes the subject matter of example 23, including or omitting optional elements, wherein the multi-frequency antenna elements are disposed in a sparse array pattern, a lattice array pattern, or an aperiodic array pattern.

Example 26 includes the subject matter of example 23, including or omitting optional elements, wherein the multi-frequency antenna elements are disposed in a sparse array pattern.

Example 27 includes the subject matter of example 22, including or omitting optional elements, wherein the multi-frequency antenna elements are disposed in a lattice array pattern.

Example 28 includes the subject matter of example 22, including or omitting optional elements, wherein the multi-frequency antenna elements are disposed in an aperiodic array pattern.

It is to be understood that aspects described herein may be implemented by hardware, software, firmware, or any combination thereof. Various illustrative logics, logical blocks, modules, and circuits described in connection with aspects disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform functions described herein. A general-purpose processor may be a microprocessor, but, in the alternative, processor may be any conventional processor, controller, microcontroller, or state machine. A processor may also be implemented as a combination of computing devices, for example, a combination of a DSP and a microprocessor, a plurality of microprocessors, one or more microprocessors in conjunction with a DSP core, or any other such configuration. Additionally, at least one processor may include one or more modules operable to perform one or more of the acts and/or actions described herein. Further, the acts and/or actions of a method or algorithm described in connection with aspects disclosed herein may be embodied directly in hardware, in a software module executed by a processor, or a combination thereof.

In this regard, while the disclosed subject matter has been described in connection with various embodiments and corresponding Figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. A retrodirective array, comprising:

a plurality of dual-polarized antenna elements configured to receive a pilot signal comprising a first polarization;

phase conjugation circuitry, comprising, for each dual-polarized antenna element of the plurality of dual-polarized antenna elements:

a mixer configured to mix the pilot signal with a local oscillator signal to generate a phase conjugated signal; and excitation circuitry configured to generate a pair of differential excitation signals for each dual-polarized antenna element of the plurality of dual-polarized antenna elements to transmit the phase conjugated signal with a second polarization that is different from the first polarization.

2. The system for a retrodirective array of claim 1, wherein the pilot signal and the phase conjugated signal comprise the same frequency.

3. The system for a retrodirective array of claim 1, wherein the excitation circuitry comprises a 180° hybrid coupler circuitry.

4. The system for a retrodirective array of claim 1, wherein the excitation circuitry comprises a power splitter with 180° phase offset.

5. The system for a retrodirective array of claim 1, wherein each dual-polarized antenna element of the plurality of dual-polarized antenna elements comprises a first port and a second port configured to transmit signals with the second polarization and a third port configured to receive signals comprising the first polarization.

6. The system for a retrodirective array of claim 1, wherein each dual-polarized antenna element of the plurality of dual-polarized antenna elements comprises a first port and a second port, wherein the first port and the second port comprise the second polarization, wherein the retrodirective array further comprises and a third port comprising the first polarization.

7. The retrodirective antenna array of claim 1, wherein each dual-polarized antenna element of the plurality of dual-polarized antenna elements comprises at least one radiating element and further wherein a first port and a second port are coupled to opposite edges of a radiating element.

8. The system for a retrodirective array of claim 1, wherein each dual-polarized antenna element of the plurality of dual-polarized antenna elements comprises at least one radiating element and further wherein a first port and a second port are coupled to opposite corners of a radiating element.

9. The system for a retrodirective array of any of claim 1, wherein the pilot signal comprises differential signals.

10. A method, comprising:

receiving a pilot signal comprising a first polarity with an antenna element, wherein the pilot signal is received at an angle of arrival with reference to the antenna element;

mixing the pilot signal with a local oscillator signal to generate a phase conjugated signal;

generating a pair of differential excitation signals, for the antenna element to transmit the phase conjugated signal with a second polarity that is different from the first polarity; and providing the pair of differential excitation signals to the antenna element.

11. The method of claim 10, wherein the pilot signal and the phase conjugated signal comprise the same frequency.

12. The method of claim 10, further comprising providing the pair of differential signals to a pair of ports on the antenna element, wherein the pair of ports are disposed at opposite edges of a radiating element.

13. An antenna element, comprising:

a first radiating element configured to transmit at a first frequency;

a first port coupled to the first radiating element, wherein the first port is configured to apply a first excitation signal to the first radiating element to transmit a first transmit signal at a first polarization;

a second port coupled to the first radiating element, wherein the second port is configured to apply a second excitation signal to the first radiating element to transmit a second transmit signal at a second polarization different from the first polarization;

a second radiating element configured to transmit at a second frequency that is different from the first frequency;

a third port coupled to the second radiating element, wherein the third port is configured to apply a third excitation signal to the second radiating element to transmit a third transmit signal at the first polarization; and a fourth port coupled to the second radiating element, wherein the fourth port is configured to apply a fourth excitation signal to the second radiating element to transmit a fourth transmit signal at the second polarization.

14. The antenna element of claim 13, wherein the first frequency is higher than the second frequency.

15. The antenna element of claim 13, wherein the first radiating element is disposed on top of the second radiating element.

16. The antenna element of claim 15, wherein the second radiating element comprises a first clearance hole for a via connected to the first port to pass through and a second clearance hole for a via connected to the second port to pass through.

17. The antenna element of claim 13, wherein an impedance of the first port and the second port are selected to be matched at the first frequency and mismatched at the second frequency and wherein an impedance of the third port and the fourth port are selected to be matched at the second frequency and mismatched at the first frequency.

18. The antenna element of claim 13, further comprising:

a third radiating element configured to transmit at a third frequency that is different from the first frequency and the second frequency;

a fifth port coupled to the third radiating element, wherein the fifth port is configured to apply a fifth excitation signal to the third radiating element to transmit a fifth transmit signal at the first polarization; and a sixth port coupled to the third radiating element, wherein the sixth port is configured to apply a sixth excitation signal to the third radiating element to transmit a sixth transmit signal at the second polarization.

19. The antenna element of claim 13, wherein each of the radiating elements comprises a rectangular patch of conductive material.

20. The antenna element of claim 19, wherein each of the radiating elements comprises a circular, elliptical, or irregularly-shaped patch of conductive material.

21. A phased array antenna, comprising a plurality of multi-frequency antenna elements disposed in a pattern, wherein each multi-frequency antenna element is configured to transmit signals at a combination of a first frequency and a second frequency simultaneously.

22. The phased array antenna of claim 21, wherein the multi-frequency antenna elements are disposed in a matrix array pattern.

23. The phased array antenna of claim 21, wherein the multi-frequency antenna elements are disposed in a sparse array pattern, a lattice array pattern, or an aperiodic array pattern.

* * * * *